US005390390A

United States Patent [19]

Kresse et al.

[11] Patent Number: 5,390,390

[45] Date of Patent: * Feb. 21, 1995

[54] MOP HEAD WITH A POUCH AND A STRAP

[75] Inventors: Franz Kresse, Hilden; Rainer Osberghaus, Duesseldorf; Bernfried Scheller, Pulheim; Roland Schunter, Lorch-Waldhausen; Michael Bergmann, Duesseldorf, all of Germany

[73] Assignee: Henkel Kommanditgesellschaft auf Aktien, Duesseldorf, Germany

[ * ] Notice: The portion of the term of this patent subsequent to Oct. 19, 2010 has been disclaimed.

[21] Appl. No.: 856,212

[22] PCT Filed: Nov. 13, 1989

[86] PCT No.: PCT/EP90/01830

§ 371 Date: Jul. 13, 1992

§ 102(e) Date: Jul. 13, 1992

[87] PCT Pub. No.: WO91/07129

PCT Pub. Date: May 30, 1991

[30] Foreign Application Priority Data

Nov. 13, 1989 [DE] Germany ..... 3937718.0

[51] Int. Cl.[6] ..... A47L 13/10; A47L 13/16; A47L 13/255

[52] U.S. Cl. ..... 15/228; 15/147.2; 15/229.8

[58] Field of Search ..... 15/119.1, 147.1, 147.2, 15/228, 229.1, 229.2, 229.3, 229.4, 229.6, 229.7, 229.8

[56] References Cited

U.S. PATENT DOCUMENTS

| | | | |
|---|---|---|---|
| 2,655,680 | 10/1953 | Geerin | 15/228 |
| 3,085,271 | 4/1963 | Janssen | 15/229.8 |
| 3,324,495 | 6/1967 | Van Schwartz | 15/147.2 |
| 4,680,826 | 7/1987 | Schunter | 15/229.8 |
| 4,961,242 | 10/1990 | Kresse | 15/228 |
| 5,253,387 | 10/1993 | Kresse et al. | 15/147.2 |

FOREIGN PATENT DOCUMENTS

| | | | |
|---|---|---|---|
| 002812 | 1/1990 | Australia | 15/119.1 |
| 0451443 | 10/1991 | European Pat. Off. | 15/147.2 |
| 3823456 | 7/1989 | Germany | 15/228 |

*Primary Examiner*—Timothy F. Simone
*Assistant Examiner*—Randall E. Chin
*Attorney, Agent, or Firm*—Ernest G. Szoke; Wayne C. Jaeschke; Kenneth Watov

[57] ABSTRACT

A mop head for washing or wiping floors is adapted to fit on a mop holder having two plastic flaps which can be folded back upon each other, whereby the mop head includes securing members for securing it to one end of one flap of the mop holder, with the mop head further including a fabric layer having a pouch on one short side, and a strap on the other short side, whereby the strap can be tightly stretched on the one flap end via the securing members.

22 Claims, 3 Drawing Sheets

MOP HEAD WITH A POUCH AND A STRAP

BACKGROUND 1.0 Field of the Invention

This invention relates generally to a mop head for the wet or damp wiping of floors, and more particularly to mop heads including an elongate textile layer which carries mop fringes and which is adapted to the shape of two plastic flaps of a mop holder with the flaps being adapted to snap together from a locked working position, the mop holder also including fastening elements for the releasable fixing of the mop head.

2.0 Discussion of Related Art

Mop head/mop holder systems in the field of the invention are used, for example, in institutional room cleaning.

A mop head described in DE-OS 37 14 178, comprises either a pocket at each longitudinal end, and an additional fastening element for fixing the mop head to the flaps of the mop holder, or two pockets on its upper surface and an additional fastening element on only one pocket. Similar mop heads are described in DE-PS 32 46 161, and DE-OS 37 14 178.

With these known mop heads, the two flap ends are supposed to be secured in the pockets of the mop head in the working position, i.e. during wiping, and thus facilitate the wiping movements. The additional fastening elements are provided to enable the mop head to be placed in washing buckets and presses for washing and squeezing out without having to be touched by hand. The additional fastening elements are designed in such a way that, when the flaps of the mop holder snap together, they come free from the pockets so that the mop head can only be offered to the washing bucket or the press hanging from the additional fastening elements. Depending on its construction, the mop head either hangs down lengthwise from a holder flap, where it is fixed at only one end or, where it is fixed at both ends, depends from the mop holder in the manner of a swing. After they have been squeezed out, the mop heads are placed back on the floor, the ends of the holder flaps are inserted into the pockets and the mop holder is brought into locked working position. All the operations described above are supposed to take place without the hand of the cleaner coming into contact with the mop head.

In view of this requirement, however, known mop heads have disadvantages, which do result in the hand of the user coming into contact with the mop head.

In one version which is described in DE-PS 32 46 161, the additional fixing plate is stitched to the pocket at the longitudinal end of the textile layer inside the pocket. If, now, the flap end attached to the additional fixing element comes free from the pocket, the mop head cannot in any way extend lengthwise downwards (to form almost a vertical extension of the flap end), being prevented from doing so by the opening edge facing the handle holder of the mop holder or rather by the width of the pocket. Because the pocket is stitched to the textile layer and where the end of the flap extends substantially vertically for large areas of the mop head, a part of the mop head is always inclined more or less horizontally thereto, substantially corresponding to the width of the pocket longitudinally of the textile layer. This part prevents the wet mop from being completely squeezed out, for example in roller presses. The danger arises that this end cannot be properly inserted into the roller press or may even snap back onto the end of the flap so that it cannot be squeezed out at all.

Moreover, the additional fixing plate must be of such a length that the flap end attached to it is unable to come free from the pocket. Problems thus arise when the end of the flap is re-inserted into the pocket because the additional fixing plate—by folding back and bending—prevents insertion of the flap end into the pocket. This disadvantage also attends the other known version where, besides pockets, additional fixing plates are arranged outside the pocket at both longitudinal ends of the textile layer.

In view of the disadvantages described above, the person using this cleaning system very quickly and spontaneously uses his or her hand to eliminate the difficulties arising.

In the known mop heads, further fastenings are provided in addition to the pockets and are made even longer than the pockets. This adds to the cost of the damp wiping mops through the additional material and additional production steps required in relation to standard mop heads having two pockets.

3.0 SUMMARY OF THE INVENTION

An object of the present invention is to provide an improved mop head both in regard to hygienic washing and squeezing out, and in regard to the improved use of material.

In a mop head of the type defined above, provides in the region opposite the pocket a fixing plate with fastening elements which is fixed to the textile layer, and which is designed to be tightly secured to a plastic flap of the mop holder by means of the fastening elements.

The invention provides a mop head in which—after fitting and attachment of the head to the holder with flap ends snapping together—one flap end comes free from the pocket so that the mop head hangs vertically over its entire length from the flap end attached to the fixing plate. In this way, the mop head can be easily introduced into roller presses and squeezed out over its entire length. The cleaner no longer has to touch the mop head by hand. Another advantage is that only one pocket and the fixing plate are formed on the damp wiping mop. This in itself represents a considerable saving of material over known mop heads.

A further saving of material is achieved through the fact that the fixing plate can now be made distinctly shorter than in the prior art because, according to the invention, the flap end attached to the fixing plate does not have to come free from a pocket.

In order to give the fixing plate sufficient flexibility for vertical orientation in relation to the hanging mop head, the fixing plate is subsequently fixed directly to the fringe-carrying part of the textile layer and is made flexible and, in particular, film-like at least in this fixing zone.

In addition to the fastening elements for securing the fixing plate to the flap end, it can be useful according to another embodiment of the invention, which seeks to improve stability and force transmission to the flap end, to provide a loop-like or annular holder on the fixing plate for accommodating the flap end.

A particularly low input and consumption of material in relation to known mop heads is obtained if, in accordance with another embodiment of the invention, the fixing plate is a strip from 1 to 3 cm wide stitched to the textile layer at its longitudinal ends.

In another embodiment of the invention, the fastening elements are arranged on the fixing plate and the end of the flap in the immediate vicinity of the attachment of the fixing plate to the textile layer. The attachment of the fixing plate to the flap end obtained in this way is particularly favorable for wiping and particularly suitable for the accompanying distribution and transmission of forces.

Since the mop head comes into contact with, in some cases, aggressive cleaning products and since the fixing plate is intended to be at least locally flexible, another embodiment of the invention is characterized in that the fixing plate is made of plastic, more particularly a thermoplastic based on polyether esters.

To transmit the forces occurring between the mop holder and the mop head during wiping, it is of particular advantage if the fixing plate has sufficient natural rigidity for the transmission of forces from the holder to the textile layer during wiping. This embodiment of the invention provides for the effective and problem-free transmission of forces from the holder via the fastening elements arranged in the fixing plate and the fixing plate itself to the textile layer 11 by means of the fastenings arranged on the holder.

This natural rigidity is also of particular advantage in cases where the fixing plate and the flap to which it is attached are intended to be displaceable relative to one another.

To enable the fixing plate to be attached simply to the flap, another embodiment of the invention is characterized in that the fastening elements are formed by holes in the fixing plate and corresponding projecting screw heads or studs which are fixedly formed on one flap end and which co-operate with the holes.

Finally, to allow relative displacement between the fixing plate and the flap, another embodiment of the invention includes slots for the fastening elements.

BRIEF DESCRIPTION OF THE DRAWINGS

The invention is described in more detail below with reference to the accompanying drawings in which like items are identified by the same reference designation, wherein.

DETAILED DESCRIPTION OF THE INVENTION

Figure 1:
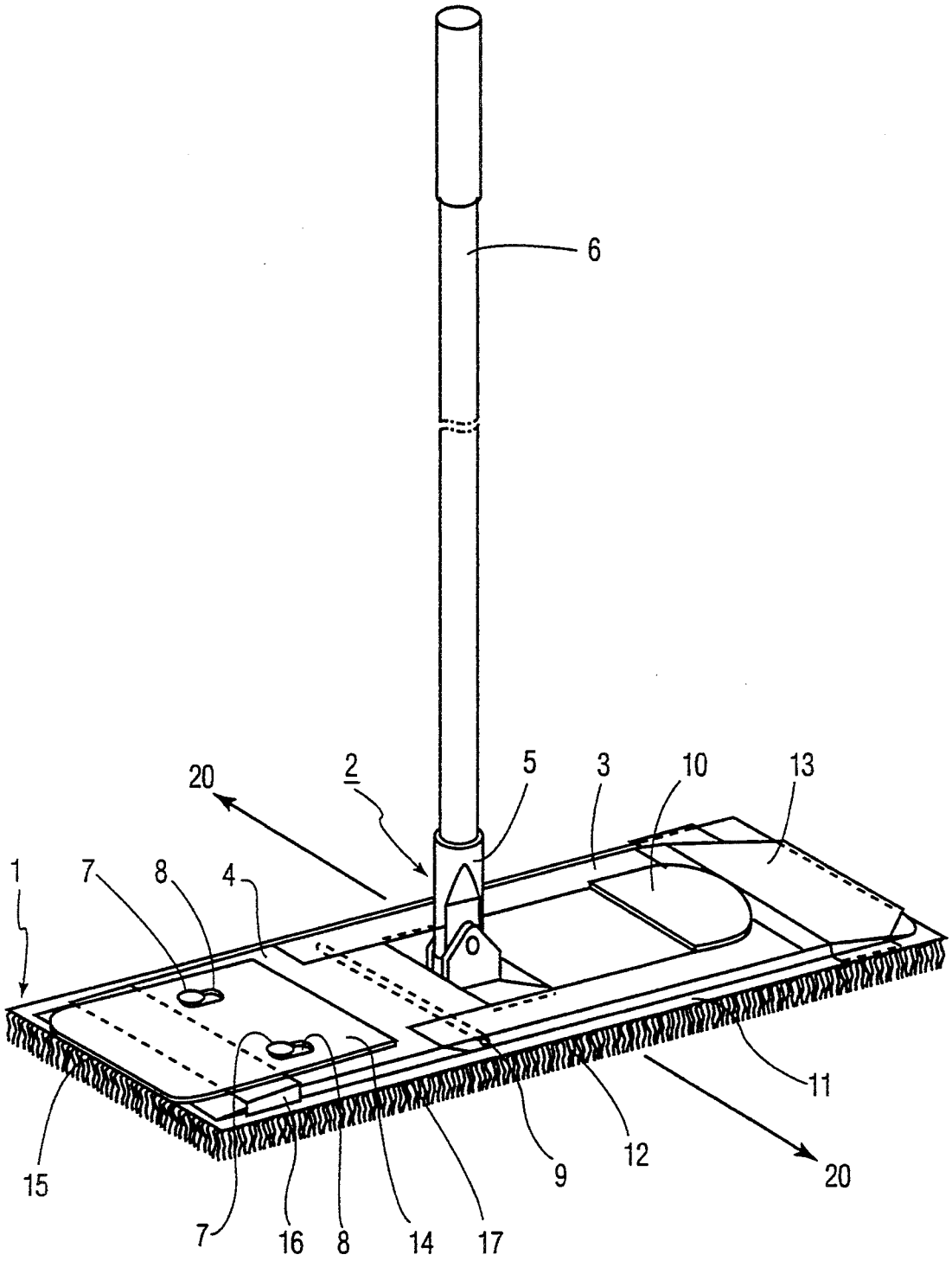
FIG. 1 shows a mop holder in the working position of a first embodiment of the mop head.

FIG. 1 shows a mop head 1 for the wet or damp wiping of floors. The mop head 1 is fitted onto a mop holder 2. The mop holder 2 consists of two plastic flaps 3 and 4, which are designed to snap together from the locked working position shown in the Figures. In addition, the mop holder comprises a universally suspended handle mount 5 arranged on the plastic flap 4, and a handle 6 secured in the handle mount 5. Fastening elements in the form of fixedly projecting screw heads or studs 7 are arranged on the upper surface of the plastic flap 4 for releasably securing the mop head 1. The fastening elements 7 co-operate with fastenings correspondingly formed on the mop head 1. In the embodiments shown in FIGS. 1 and 2, these fastenings are formed by holes 8 and, in the embodiment shown in FIG. 3, by slots 18. However, the fastening elements 7 and 8 may also be formed by buttons, push buttons, hook-and-loop fastenings or the like. The two plastic flaps 3 and 4 are mounted to pivot about an axis 9 so that they can be snapped together. A foot key 10 is used to release the locked working position shown in FIGS. 1 to 3.

The mop head 1 consists of an elongate textile layer 11 adapted to the shape of the mop holder 2. Mop fringes 12 are fixed to the bottom of the textile layer 11. The textile layer 11 has fringe-free zones on its upper surface. These fringe-free zones are in the form of a pocket 13 at one longitudinal end of the mop head 1, and in the form of a fixing plate 14 at the other longitudinal end of mop head 1. The pocket 13 is preferably stitched to the upper surface of the mop head 1 both at the longitudinal end and at the transverse sides. By contrast, the fixing plate 14 is only fixed to the textile layer 11 at its longitudinal end. The fixing plate 14 consists of a film-like structure of plastic, and is directly stitched to the part carrying the fringes 12 by means of a seam 15 extending parallel to the longitudinal-end edge of the mop head 1 on the upper surface of the textile layer 11. The fixing plate 14 is flexible and, in particular, film-like at least in the region of the seam 15.

The fixing plate 14 preferably consists of a thermoplastic based on polyether esters. The thermoplastic is partly crystalline and is marketed under the name of Arnitel®, for example.

The fastening elements 8 and 18 of the fixing plate 14, and the fastenings 7 of the flap 4, are designed in such a way that the fixing plate 14 can be secured tightly to the flap 4 longitudinally of the holder 2. In the illustrated embodiments, this is accomplished by "threading" the fastening elements 7 in the holes 8 or slots 18. The embodiment shown in FIG. 3 has the particular feature in this regard that the fastening elements 7 move from the locked working position illustrated, in which they bear against the longitudinal-end slot 18 boundaries with the flaps 3 and 4 snapped together, into the opposite stop position where they bear against the slot boundaries facing the handle 6. This results in a relative displacement between the fixing plate 14 and the flap 4, whereby the distance between the seam 15 and the longitudinal-end edge 19 of the flap 4 increases. For squeezing out the mop head 1 in roller presses, a larger space is thus created between the longitudinal-end edge of the textile layer 11 carrying mop fringes 12, and the edge 19 of the flap with the mop head 1 hanging vertically lengthwise.

Figure 3:
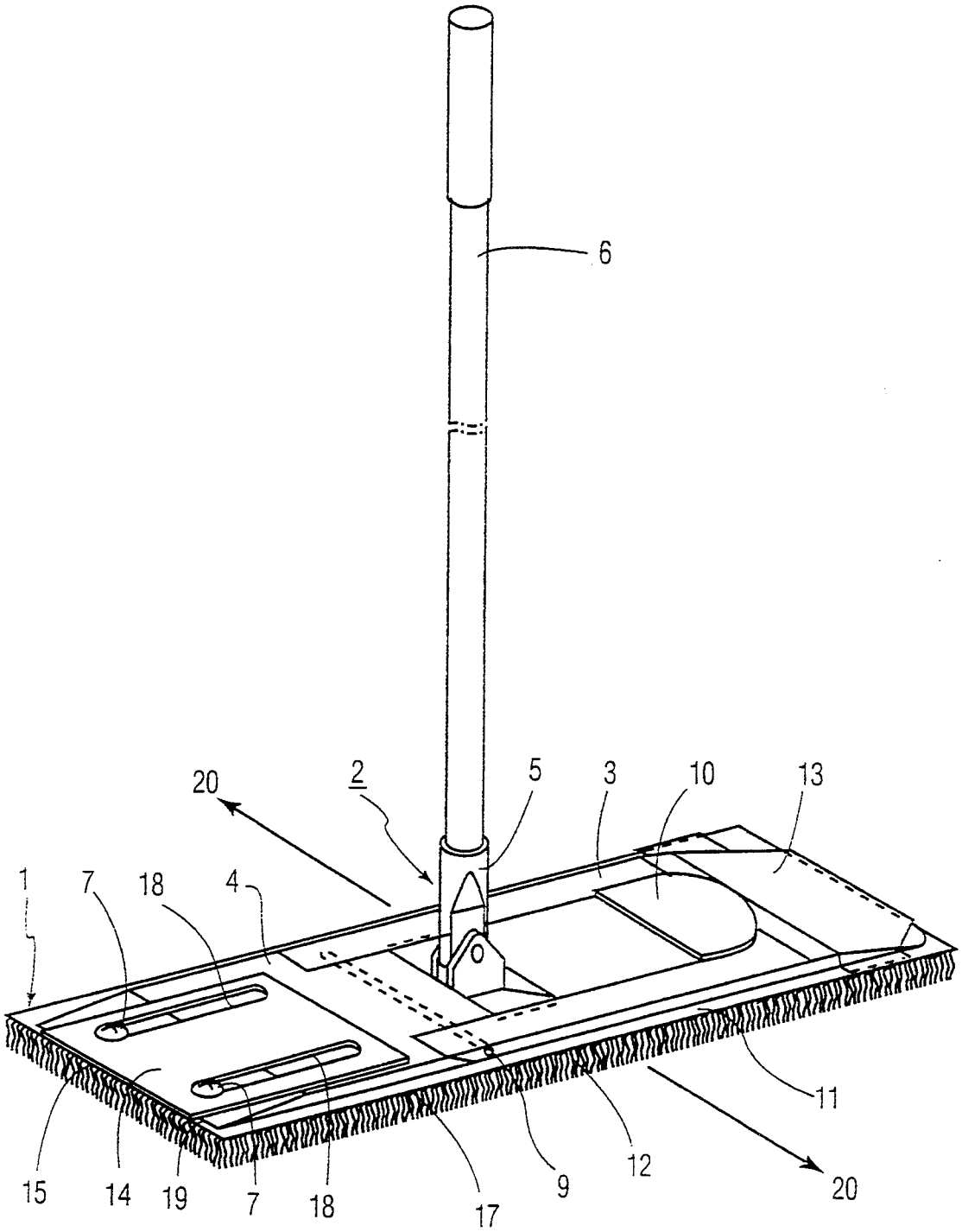
FIG. 3 shows a mop holder in the working position of yet another embodiment of the mop head.

Although the fixing plate 14 is flexible and, in particular, film-like, at least in the region of the seam 15, it still has sufficient natural rigidity for the transmission of forces from the holder 2 to the textile layer, during wiping and for the relative displacement between the fixing plate 14 and the flap 4 in the embodiment shown in FIG. 3. In other words, the natural rigidity of the fixing plate 14 is sufficient to absorb the forces acting on the fixing plate 14 via the fastening elements 7, particularly during wiping movements in the direction of the arrow 20, and to transmit them to the textile layer without the fixing plate 14 being folded back or bent.

In the embodiment shown in FIG. 1, a loop-like or annular holder 16 is formed on the underneath of the fixing plate 14 to accommodate the end of the flap 4.

Figure 2:
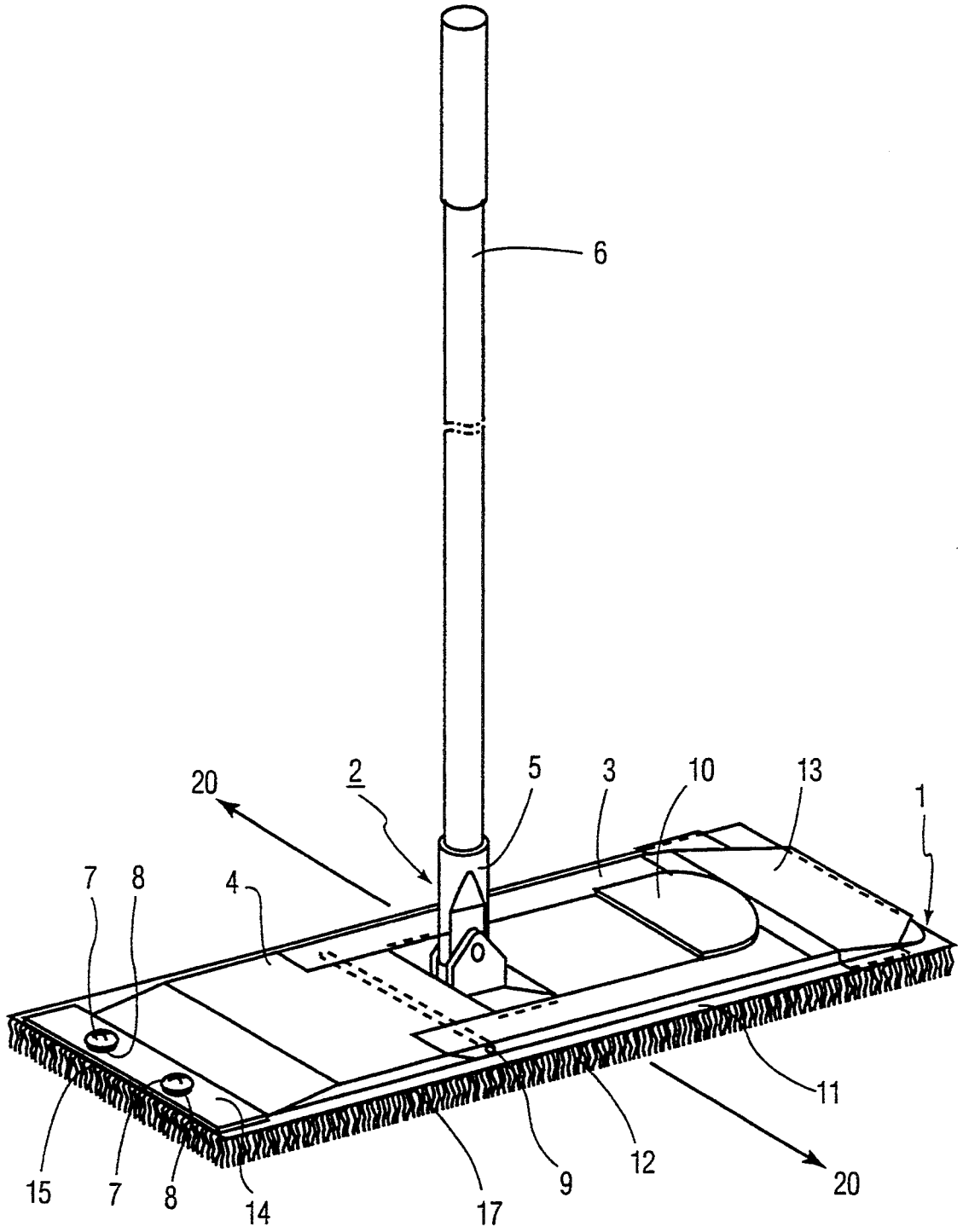
FIG. 2 shows a mop holder in the working position of another embodiment of the mop head.

In the embodiment shown in FIG. 2, the fixing plate 14 is in the form of a narrow strip between 1 and 3 cm in width, for example. In addition, the fastening elements 7 formed on the end of the flap 4 to correspond to the fastening elements 8 are arranged closely to the longitudinal-end edge of the flap 4, for insuring that when the mop head 1 is fixed to the end of the flap 4 as illustrated, the fastening elements on the fixing plate 14 and the end of the flap 4 are situated in the immediate vicinity of the seam 15.

In use, the mop holder 2 is mounted upon to the mop head 1 with the flaps 3,4 folded together. The plastic flap 3 is first inserted into the pocket 13, after which the mop holder 2 is pressed down into the locked working position shown in FIGS. 1 to 3. The fixing plate 14 is then secured to the flap 4 via means of the fastening elements 7 and 8, or 7 and 18. With the illustrated fastening elements, this is accomplished by threading the screw-like heads 7 into the holes 8 or slots 18 of the fixing plate 14. In this position, the mop head 1 with the mop holder 2 is ready for wiping. To wash and squeeze out the mop, the foot key 10 is depressed so that the flaps 3 and 4 are unlocked and snap together when the handle 6 is lifted. The pocket 13 slides from the end of the flap 3, whereby the mop head 1 is only held on the end of the other flap 4 by means of the fixing plate 14. The mop head 1 then hangs almost vertically from the flap 4 because the fixing plate 14 is flexibly secured solely by means of a longitudinal-end seam 15 directly adjoining that part of the textile layer 11, which carries the mop fringes 12. The fixing plate 14 does not have any troublesome fastenings on the transverse side of the textile layer 11. In this regard, the loop-like holder 16 provided in FIG. 1 for the end of the flap 4 is not attached to the upper surface of the textile layer 11, but only to the bottom or inside of the fixing plate 14. In its vertically hanging position, the mop head 1 can be placed both in washing buckets and in presses, and can be introduced into the press and squeezed out over the entire length of the fringe-carrying part. The mop head 1 is then placed back on the floor and the flap 3 is reinserted into the pocket 13.

A plastic bar or a plastic rib may be arranged at the side edges of the fixing plate 14 parallel to the transverse side 17 of the mop head 1 in order to offer the fixing plate 14 in an open position—similar to the opening of the pocket 13—for insertion of the end of the flap 4.

The described mop head can be modified or amplified in various ways without departing from the basic concept of the invention. For example, a plastic bar or a plastic rib may be arranged at the side edges of the fixing plate 14, parallel to the transverse side 17 of the mop head 1, in order to place the fixing plate 14 in an open position, similar to the opening of the pocket 13, for insertion of the end of the flap 4.

What is claimed is:

1. A mop for the wet or damp wiping of floors, comprising:

a pole-like handle having two ends;

a mop head including first and second ends;

a mop holder for receiving said mop head;

said mop holder including:

first and second flaps each having an inner end and an outer end;

handle mount means, rigidly attached to a central portion of said inner end of said second flap, for receiving and securing one end of said handle thereto;

pivot means defining a common axis for connecting said inner ends of said first and second flaps to one another, for permitting said first and second flaps to lie in the same horizontal plane when said mop holder is positioned proximate a floor in a working position, and for permitting said first and second flaps to pivot downward about said common axis, folding together upon one another, whenever said handle is lifted upward for suspending said mop holder over the floor in a non-working position;

first fastening means proximate the outer end of said first flap and on a top surface thereof, for attachment to said mop head;

said mop head including:

an elongate textile layer carrying mop fringes, and substantially shaped to conform to the shape of said first and second flaps in the working position, said textile layer having first and second ends;

second fastening means secured to the first end of said textile layer, for engaging and being cooperative with said first fastening means of said mop holder, for releasably securing the outer end of said first flap and first end of said mop head together; and a pocket free from fastenings being formed at the second end of said textile layer, for receiving the outer end of said second flap in the working position.

2. The mop of claim 1, further including:

foot operated locking means for selectively locking or unlocking said first and second flaps into and out of the working position, whereby when said first and second flaps are locked together in the working position, they are prevented from folding downward when said handle is lifted upward to lift said mop away from the floor.

3. The mop of claim 11, wherein said pivot means includes:

the width of a portion of said first flap proximate the inner end thereof being narrower than the width of a second portion of the first flap proximate its outer end;

a portion of said second flap, proximate its inner end being cutout, for receiving the narrowed inner end of said first flap; and means connecting together said portions proximate the inner ends of said first and second flaps along said common axis, for permitting said inner ends to pivot about the common axis and fold together.

4. A mop head as claimed in claim 1, wherein said second fastening means includes a thin and flat securement plate directly attached to said first end of the textile layer, said securement plate being flexible and, in particular, film-like at least in an area of the first end of said textile layer, said securement plate including cut through portions cooperative with said first fastening means for securing said first end of said textile layer to the outer end of said first flap.

5. A mop head as claimed in claim 4, further including a loop-like or annular holder formed on the securement plate for receiving the outer end of the first flap.

6. A mop head as claim in claim 5, wherein said securement plate is selected to have sufficient natural rigidity for the transmission of forces from the holder to the textile layer during wiping.

7. A mop head as claimed in claim 4, wherein said securement plate includes a strip of flexible material from 1 to 3 cm wide stitched to the first end of the textile layer.

8. A mop head as claimed in claim 4, wherein said first and second fastening means are arranged on the first flap and the outer end of the first flap, respectively, in the immediate vicinity of the attachment of the securement plate to the textile layer.

9. A mop head as claimed in claim 4, wherein said securement plate is made of plastic material.

10. A mop head as claimed in claim 9, wherein said plastic material is a thermoplastic including polyether esters.

11. A mop head as claimed in claim 4, wherein said securement plate is selected to have sufficient natural rigidity for the transmission of forces from the holder to the textile layer during wiping.

12. A mop head as claimed in claim 4, wherein said second fastening means are formed by holes in the securement plate, and said first fastening means are formed by corresponding projecting screw heads or studs fixedly formed on the first flap to cooperate with said holes.

13. A mop head as claimed in claim 4, wherein the cut through portions of said securement plate are slots.

14. A mop for the wet or damp wiping of floors, comprising:

a pole-like handle having two ends;

a mop head including first and second ends;

a mop holder for receiving said mop head;

said mop holder including:

first and second flaps each having an inner end and an outer end;

handle mount means, rigidly attached to a central portion of said inner end of said second flap, for receiving and securing one end of said handle thereto;

pivot means defining a common axis for connecting said inner ends of said first and second flaps to one another, for permitting said first and second flaps to lie in the same horizontal plane when said mop holder is positioned proximate a floor in a working position, and for permitting said first and second flaps to pivot downward about said common axis, folding together upon one another, whenever said handle is lifted upward for suspending said mop holder over the floor in a non-working position;

first fastening means proximate the outer end of said first flap and on a top surface thereof, for attachment to said mop head;

said mop head including:

an elongate textile layer carrying mop fringes, and substantially shaped to conform to the shape of said first and second flaps in the working position, said textile layer having first and second ends;

second fastening means secured to the first end of said textile layer, for engaging and being cooperative with said first fastening means of said mop holder, said second fastening means including a thin and flat securement plate directly attached to said first end of the textile layer, said securement plate being flexible and, in particular, film-like at least in an area of the first end of said textile layer, said securement plate including cut through portions cooperative with said first fastening means for releasably securing said first end of said textile layer to the outer end of said first flap; and a pocket free from fastenings being formed at the second end of said textile layer, for receiving the outer end of said second flap in the working position.

15. A mop head as claim in claim 14, further including a loop-like or annular holder formed on the securement plate for receiving the outer end of the first flap.

16. A mop head as claimed in claim 14, wherein said securement plate includes a strip of flexible material from 1 to 3 cm wide stitched to the first end of the textile layer.

17. A mop head as claimed in claim 14, wherein said first and second fastening means are arranged on the first flap and the outer end of the first flap, respectively, in the immediate vicinity of the attachment of the securement plate to the textile layer.

18. A mop head as claimed in claim 14, wherein said second fastening means are formed by holes in the securement plate, and said first fastening means are formed by corresponding projecting screw heads or studs fixedly formed on the first flap to cooperate with said holes.

19. A mop for the wet or damp wiping of floors, comprising:

a pole-like handle having two ends;

a mop head including first and second ends;

a mop holder for receiving said mop head;

said mop holder including:

first and second flaps each having an inner end and an outer end;

handle mount means, rigidly attached to a central portion of said inner end of said second flap, for receiving and securing one end of said handle thereto;

pivot means defining a common axis for connecting said inner ends of said first and second flaps to one another, for permitting said first and second flaps to lie in the same horizontal plane when said mop holder is positioned proximate a floor in a working position, and for permitting said first and second flaps to pivot downward about said common axis, folding together upon one another, whenever said handle is lifted upward for suspending said mop holder over the floor in a non-working position;

first fastening means proximate the outer end of said first flap and on a top surface thereof, for attachment to said mop head;

said mop head including:

an elongate textile layer carrying mop fringes, and substantially shaped to conform to the shape of said first and second flaps in the working position, said textile layer having first and second ends;

second fastening means secured to the first end of said textile layer, for engaging and being cooperative with said first fastening means of said mop holder, said second fastening means including a thin and flat securement plate directly attached to said first end of the textile layer, said securement plate being flexible and, in particular, film-like at least in an area of the first end of said textile layer, said securement plate including cut through slots cooperative with said first fastening means for releasably securing said first end of said textile layer to the outer end of said first flap; and a pocket free from fastenings being formed at the second end of said textile layer, for receiving the outer end of said second flap in the working position.

20. A mop head as claimed in claim 19, wherein said securement plate includes a strip of flexible material from 1 to 3 cm wide stitched to the first end of the textile layer.

21. A mop head as claimed in claim 19, wherein said first and second fastening means are arranged on the first flap and the outer end of the first flap, respectively, in the immediate vicinity of the attachment of the securement plate to the textile layer.

22. A mop head as claimed in claim 19, wherein said second fastening means are formed by holes in the securement plate, and said first fastening means are formed by corresponding projecting screw heads or studs fixedly formed on the first flap to cooperate with said holes.

* * * * *